US007627972B2

(12) United States Patent
Hodsdon et al.

(10) Patent No.: US 7,627,972 B2
(45) Date of Patent: Dec. 8, 2009

(54) PRINTING STOCK WITH A LABEL FOR MAKING A SECURITY BADGE

(75) Inventors: Jerry G. Hodsdon, Forestdale, MA (US); Ronald Ugolick, San Dimas, CA (US)

(73) Assignee: Avery Dennison Corporation, Pasadena, CA (US)

( * ) Notice: Subject to any disclaimer, the term of this patent is extended or adjusted under 35 U.S.C. 154(b) by 300 days.

(21) Appl. No.: 11/180,059

(22) Filed: Jul. 11, 2005

(65) Prior Publication Data

US 2006/0057325 A1 Mar. 16, 2006

Related U.S. Application Data

(60) Provisional application No. 60/588,815, filed on Jul. 15, 2004, provisional application No. 60/634,851, filed on Dec. 10, 2004.

(51) Int. Cl.
*G09F 3/18* (2006.01)

(52) U.S. Cl. ..... 40/661.09; 40/654.01; 40/586

(58) Field of Classification Search ..... 40/661.09, 40/663, 664, 665–674
See application file for complete search history.

(56) References Cited

U.S. PATENT DOCUMENTS 4,060,168 A * 11/1977 Romagnoli ..... 206/216
4,285,146 A 8/1981 Charles et al.
4,306,367 A * 12/1981 Otto ..... 40/312
4,368,244 A 1/1983 Danzig
4,653,775 A 3/1987 Raphael et al.
4,787,158 A 11/1988 Vitol
4,889,749 A 12/1989 Ohashi et al.
4,900,903 A 2/1990 Wright et al.

(Continued)

FOREIGN PATENT DOCUMENTS

DE 29 41 683 AL 10/1979

(Continued)

OTHER PUBLICATIONS

Bradesko et al., "Identification Procedures, Using The Combination Of Optical And Chipcard," IEEE, 1991, pp. 1192-1195.

(Continued)

*Primary Examiner*—Lesley D Morris
*Assistant Examiner*—Shin Kim
(74) *Attorney, Agent, or Firm*—Patent Group Law Department; Avery Dennison Corporation

(57) ABSTRACT

A piece of printing stock for making, in combination with a badge base, an information badge, includes a face sheet and a liner. The face sheet includes a layer of adhesive, with the liner releasably adhered to the layer of adhesive. The face sheet also includes a badge label, for example, as defined by a weakening line cut into the face sheet. In addition, the liner includes a badge liner, for example, as defined therein by a weakening line cut into the liner. The badge liner is smaller in dimensions than the badge label and is positioned with respect to the badge label such that when the badge label is removed from the face sheet, the badge liner is removed from the liner and remains adhered to the badge label.

31 Claims, 17 Drawing Sheets

U.S. PATENT DOCUMENTS

| | | | | | |
|---|---|---|---|---|---|
| 4,947,567 | A | * | 8/1990 | Hermann | 40/630 |
| 4,986,868 | A | | 1/1991 | Schmidt | |
| 5,058,926 | A | | 10/1991 | Drower | |
| 5,075,769 | A | | 12/1991 | Allen et al. | |
| 5,172,938 | A | | 12/1992 | Schmidt | |
| 5,180,906 | A | | 1/1993 | Yamada | |
| 5,209,514 | A | | 5/1993 | Hebert | |
| 5,284,364 | A | | 2/1994 | Jain | |
| 5,302,475 | A | | 4/1994 | Adler et al. | |
| 5,362,106 | A | | 11/1994 | Longtin | |
| 5,453,336 | A | | 9/1995 | Adler et al. | |
| 5,484,167 | A | * | 1/1996 | Donaldson et al. | 283/67 |
| 5,509,693 | A | | 4/1996 | Kohls | |
| 5,518,787 | A | | 5/1996 | Konkol | |
| 5,529,345 | A | * | 6/1996 | Kohls | 283/75 |
| 5,556,720 | A | | 9/1996 | Charkey | |
| 5,617,528 | A | | 4/1997 | Stechmann et al. | |
| 5,662,976 | A | | 9/1997 | Popat et al. | |
| D386,793 | S | | 11/1997 | Haas et al. | |
| 5,717,776 | A | | 2/1998 | Watanabe | |
| D394,675 | S | | 5/1998 | Haas et al. | |
| 5,814,796 | A | | 9/1998 | Benson et al. | |
| 5,840,143 | A | | 11/1998 | Swanson | |
| 5,884,425 | A | * | 3/1999 | Baldwin | 40/638 |
| 5,893,587 | A | | 4/1999 | Wong | |
| 5,913,542 | A | | 6/1999 | Belucci et al. | |
| 6,000,608 | A | | 12/1999 | Dorf | |
| 6,002,427 | A | | 12/1999 | Kipust | |
| D419,595 | S | | 1/2000 | Haas et al. | |
| 6,014,748 | A | | 1/2000 | Tushic et al. | |
| 6,038,012 | A | | 3/2000 | Bley | |
| 6,078,756 | A | | 6/2000 | Squilla et al. | |
| 6,104,922 | A | | 8/2000 | Baumann | |
| 6,110,864 | A | | 8/2000 | Lu | |
| 6,142,531 | A | | 11/2000 | Harris, II | |
| 6,179,201 | B1 | | 1/2001 | Chess | |
| 6,197,396 | B1 | | 3/2001 | Haas et al. | |
| 6,220,515 | B1 | | 4/2001 | Bello | |
| 6,230,148 | B1 | | 5/2001 | Pare et al. | |
| D445,127 | S | | 7/2001 | Haas et al. | |
| 6,292,092 | B1 | | 9/2001 | Chow et al. | |
| 6,308,886 | B1 | | 10/2001 | Benson et al. | |
| 6,335,799 | B1 | | 1/2002 | Provost | |
| 6,356,942 | B1 | | 3/2002 | Bengtsson et al. | |
| 6,394,356 | B1 | | 5/2002 | Zagami | |
| 6,402,028 | B1 | | 6/2002 | Graham, Jr. et al. | |
| 6,412,692 | B1 | | 7/2002 | Miyagawa | |
| 6,447,015 | B1 | | 9/2002 | Linnewiel | |
| 6,517,921 | B2 | | 2/2003 | Ulrich et al. | |
| D476,680 | S | | 7/2003 | Haas | |
| 6,632,250 | B1 | | 10/2003 | Lynch et al. | |
| 6,862,827 | B2 | * | 3/2005 | Gregory | 40/661 |
| 2002/0047263 | A1 | | 4/2002 | McCarthy et al. | |
| 2003/0168850 | A1 | | 9/2003 | Mann | |
| 2003/0173408 | A1 | | 9/2003 | Mosher, Jr. et al. | |

FOREIGN PATENT DOCUMENTS

| | | | |
|---|---|---|---|
| EP | 0 371 301 | A2 | 11/1989 |
| EP | 1 342 586 | A2 | 9/2003 |
| FR | 2683949 | | 5/1993 |
| JP | 73-026487 | | 4/1973 |
| JP | 48-26487 | | 8/1973 |
| JP | 56-143667 | | 11/1981 |
| JP | 56-147364 | | 11/1981 |
| JP | 02-135666 | | 5/1990 |
| JP | 05-23760 | | 2/1993 |
| JP | 05-023760 | | 2/1993 |
| JP | 07-161376 | | 6/1995 |
| JP | 09-298060 | | 11/1997 |
| JP | 10-083810 | | 3/1998 |
| RU | 2079186 | | 5/1997 |
| SU | 586516 | | 12/1977 |
| WO | WO 98/53984 | | 12/1998 |
| WO | WO 2004/034347 | A1 | 4/2004 |
| WO | PCT/US2005/024604 | | 12/2005 |

OTHER PUBLICATIONS

Dittman et al., "Hologram Watermarks For Document Authentications," IEEE, 2001, pp. 60-64.

Rose, "Zebra To Acquire Maker Of Photo ID Card Printers," Chicago Tribune, Nov. 20, 2003, p. 4.

Nextnode International Nework Corporation, 102310 Badge Maker Kit II product description, http://www.aniprint.com/products/102310a.htm printout dated May 4, 2004.

Access Sentry product characterization (internal document prepared by Avery Dennison Corporation), dated Feb. 26, 2003.

Access Sentry(TM) product brochure, marked with "(c) 2000 C13 Software" and accompanying CD ROM disc marked (c) 2001 C13 Software(TM).

Access Specialities ASI 2000 product brochure, Photo Gold(TM) product description and screens, and accompanying cover letter dated Oct. 17, 2002.

Access Specialities products characterization (internal documents prepared by Avery Dennison Corporation), dated Feb. 26, 2003.

AsurelD(TM) Enterprise product brochure, marked "(c) 2002 Synercard Corporation . . . Printed in Canada Jan. 2002".

Easy Lobby SVM 6.0 product characterization (internal document prepared by Avery Dennision Corporation), dated Feb. 26, 2003.

EasyLobby Badge Sample, marked with "Apr. 4, 2001".

EasyLobby product description email from EasyLobby representative, sent Feb. 18, 2003.

EasyLobby(R) SVM(TM) 6.0 Product Brochure, marked (c)2002-2003 EasyLobby, Inc.

GBC Video ID System product characterization (internal document prepared by Avery Dennision Corporation), dated Feb. 26, 2003.

HID Corporation proximity card and reader product brochure, marked as "(c) 2001 HID Corporation."

IDville ID Maker(TM) product brochure and cover letter dated Feb. 17, 2003.

IDville product characterization (internal document prepared by Avery Dennison Corporation), dated Feb. 26, 2003.

Laminex ID in a Flash(TM) producct brochure and catalog, and cover letter dated 2002.

Laminex product characterization (internal document prepared by Avery Dennison Corporation), dated Feb. 26, 2003.

Lenel OnGuard product characterization (internal document prepared by Avery Dennison Corporation), dated Feb. 26, 2003.

Lenel Systems International, Inc. press release entitled "Lenel Launches OnGuard E-VISITOR (TM), The First Internet-Based Visitor Management Solution in the Security Industry."

New York Times, "Advancing Technology Tightens Building Security," http://www.nytimes.com/2003/03/05/business, New York Times, Mar. 5, 2003.

Sisco Fast Pass product characterization. (Internal document prepared by Avery Dennison Corporation), dated Feb. 26, 2003.

Sisco Fast-Pass(R) product brochure, marked as "original Drawing Mar. 16, 2002."

Software House C*Cure(R) 800/8000 product brochure, marked "(c) 2002".

Software House produce characterization (internal document prepared by Avery Dennison Corporation), dated Feb. 26, 2003.

STOPware Passage Point product characterization (internal document prepared by Avery Dennison Corporation), dated Feb. 26, 2003.

STOPware(TM) PassagePoint v4.0 product brochure, marked with "Pricing good till Dec. 31, 2002".

Transtech Systems, Inc. Episuite product brochure, marked "(c) 2002 ImageWare Systems, Inc."

US1 Video ID System Office Secuirty—Video ID System product description, printed from http://machinerunner.com/Video-ID-systems/USI-System.html, printout Feb. 25, 2003.

Web page entitled "Alpha Card System—Identification Badge & Card System," and related pages, http://www.a-card.com/information/identificationcardsystemindex.html.
Web page entitled "Hartford Badges, your source for name badges, photo ID's and more . . . ," marked as (c) 1996-2002 by Hartford Badges.
Web page entitled "Identification Resources" and related pages, gttp://www.idresources.com/, printout dated Jul. 19, 2002.
Web page entitle "OneCard Online" and related pages, http://www.onecardonline.com/onehome.html, printout dated Jul. 19, 2002.
Web page entitled "The DeXa.Badge Offering,"http://www.slb.com/Hub/Docs/tt/nws/dexa/L2__badge.html, marked as "Copyright 2001 Schlumberger Limited".

* cited by examiner

PRINTING STOCK WITH A LABEL FOR MAKING A SECURITY BADGE

CROSS REFERENCE TO RELATED APPLICATIONS

The present application claims priority on U.S. Provisional Applications for Patent Ser. No. 60/588,815 filed Jul. 15, 2004 and 60/634,851 filed Dec. 10, 2004, the entire disclosures of which are incorporated herein by reference.

FIELD OF THE INVENTION

The present invention relates to printing stock for making security and other information badges.

BACKGROUND OF THE INVENTION

Many businesses utilize badges, such as radio frequency identification (RFID) or magnetic strip badges, in order to control access to various areas in their facilities. It is common for such businesses to supply an RFID badge to a visitor to provide either limited or complete access to an area or a facility. The badge may also provide information to the host with regard to what areas have been accessed by the visitor. Often this badge is supplied with no visual identification associating the badge with the visitor; however, it is commonly desirable to provide a visual method of association. It is also common that the addition of a photograph and/or a bar code to the visual identification may be of further benefit in the identification of the visitor and their association with the RFID badge. It is common practice to provide an RFID badge and a separate visitor identification badge or label, using either hand-written or machine-printed identification methods.

Many businesses also provide RFID or magnetic stripe badges to control and monitor employee access to their facilities. It is common practice for these businesses to purchase or lease printers that utilize thermal transfer or dye sublimation technology to print individual badges. These printers are typically costly and are frequently difficult to justify if the number of employees is relatively small.

Accordingly, there is a need in the art for methods and apparatus that facilitate and enhance the making of security or control-access badges. The present invention satisfies one or more of these needs.

SUMMARY OF THE INVENTION

The present invention relates to printing stock for making security and other name-type badges.

According to one aspect of the invention, and by way of example only, printing stock for making, in combination with a badge base, an information badge, includes a face sheet and a liner. The face sheet includes a layer of adhesive, with the liner releasably adhered to the layer of adhesive. The face sheet also includes a badge label, for example, as defined by a weakening line cut into the face sheet. In addition, the liner includes a badge liner, for example, as defined therein by a weakening line cut into the liner. The badge liner is smaller in dimensions than the badge label and is positioned with respect to the badge label such that when the badge label is removed from the face sheet, the badge liner is removed from the liner and remains adhered to the badge label.

The relationship between the badge label and the badge liner presents a number of advantages in making information badges, such as controlled-access badges, security badges, and name badges. For example, the badge liner reduces the amount of exposed adhesive when the badge label is removed from the printing stock. Accordingly, a user is better able to position and align the badge label on a badge base. When properly positioned on the badge base, the badge liner may then be removed from the badge label to fully adhere the badge label to the base. If the badge label is initially misaligned on the badge base, a user can remove the badge label, and then reposition the badge label on the badge base.

In addition, to prevent re-use, the badge label may include a destruct discontinuity, for example, a weakening line cut into the badge label. Accordingly, when a printed badge label is removed from a badge base (e.g., so that the badge base can be reused), the printed badge label tears at the destruct continuity, thereby destroying the printed badge label.

Another advantage of the printing stock is that in a number of embodiments, the face sheet has dimensions for enabling passage of the printing stock through a small-office home-office (SOHO) printer, such as inkjet and laser printers. These printers are relatively inexpensive and are commonly used by consumers and businesses of all sizes. For example, the printing stock or the face sheet may be substantially rectangular with dimensions of about 4 inches by about 6 inches. In addition, the badge label may have dimensions that complement and correspond to standard-sized badge bases, e.g., about 3⅜ inches by about 2⅛ inches Other features and advantages of the present invention will become apparent to those skilled in the art from a consideration of the following detailed description taken in conjunction with the accompanying drawings.

DETAILED DESCRIPTION OF THE INVENTION

Figure 1:
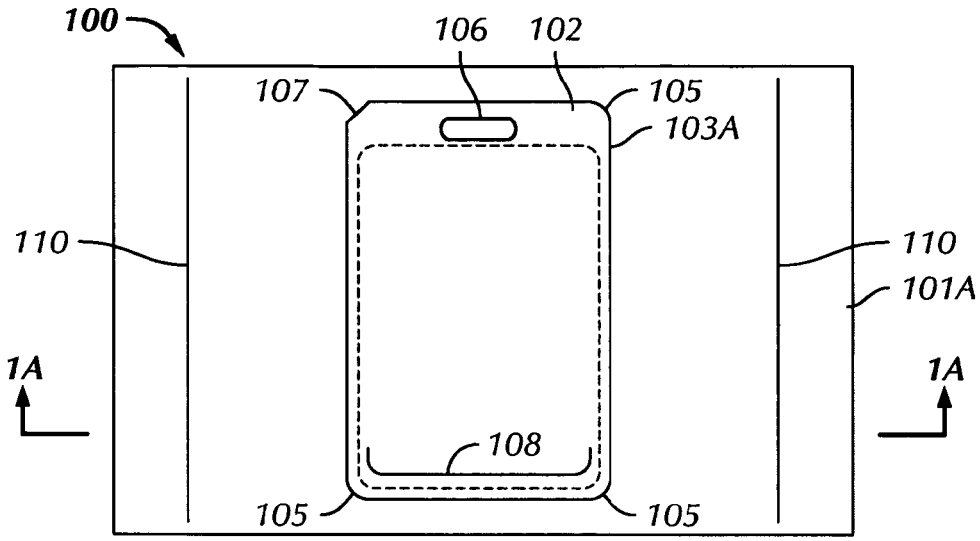
FIG. 1 is a front plan view of a sheet of printing stock with a removable badge label.
Figure 1A:
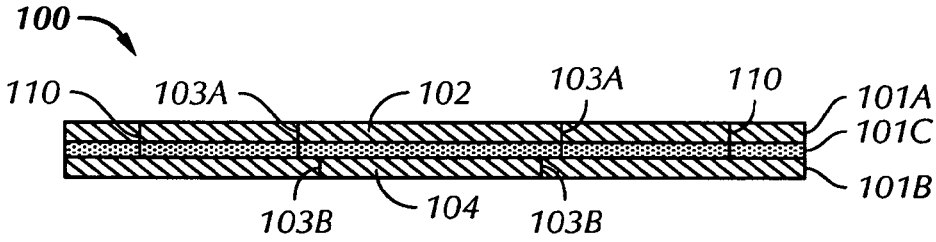
FIG. 1A is a cross-sectional view taken along line 1A-1A of FIG. 1.

Referring more particularly to the drawings, printing stock 100 for making, in combination with a badge base (indicated by reference 122 in FIG. 6), an information badge is illustrated in FIG. 1. According to a number of embodiments as particularly illustrated in FIG. 1A, the piece of printing stock 100 may include a face sheet 101A and a release liner 101B. The face sheet 101A may include adhesive 101C, for example, in the form of a layer of adhesive 101C, with the liner 101B releasably adhered to the adhesive 101C.

As shown in FIG. 1, the face sheet 101A may include a badge label 102 defined therein, for example, by a weakening line 103A. The weakening line 103A can include a plurality of continuous die-cut lines about a complete perimeter of the front portion of the badge label and the front portion of the badge label is free of perforated fold lines. With additional reference to FIG. 2, the liner 101B may include a badge liner 104 defined therein, for example, by a weakening line 103B. The weakening line 103B can include a plurality of continuous die-cut lines about a complete perimeter of the badge liner. According to a number of embodiments, the badge liner 104 is smaller in dimensions at least along one of the sides of the badge label 102. In addition, the badge liner 104 is positioned spatially within or superimposed with the badge label 102. Accordingly, when the badge label 102 is removed from the face sheet 101A, the badge liner 104 is removed from the liner 101B by remaining adhered to the badge label 102. In addition, when the badge label 102 is removed from the face sheet 101A, a portion of the adhesive 101C is exposed.

The relationship between the badge label 102 and the badge liner 104 presents a number of advantages in making information badges, such as controlled-access badges, security badges, and name badges. For example, the badge liner 104 reduces the amount of exposed adhesive when the badge label 102 is removed from the printing stock 100. Accordingly, a user is better able to position and align the badge label 102 on a badge base or card. When properly positioned on the badge base, the badge liner 104 may then be removed from the badge label 102 to fully adhere the badge label 102 to the base.

Another advantage of the printing stock 100 is that in a number of embodiments, the face sheet 101A has dimensions for enabling passage of the printing stock 100 through a small-office home-office (SOHO) printer, such as inkjet and laser printers which are typically and relatively inexpensive and which are commonly used by consumers and small business. For example, the printing stock 100 or the face sheet 101A may be substantially rectangular with dimensions of about 4 inches by about 6 inches. In addition, in embodiments in which a standard-sized badge base is utilized, the badge label 102 may be substantially rectangular with dimensions of about 3⅜ inches by about 2⅛ inches.

The face stock or sheet 101A may be made of a paper or opaque film. The weakening lines 103 (and other weakening lines) may be die cut or perforations. In addition, in some of the embodiments, the badge label 102 may have dimensions that are similar or identical to those of standard badge bases, either RFID or magnetic strip badges. Three of the four corners of the badge label 102 may have a radius 105 similar to that of an RFID or magnetic strip badge, such as a ⅛-inch radius. The fourth corner may have a chamfer 107, such as shown in FIG. 1.

The badge label 102 may have a die-cut eyelet 106 that corresponds to a complementary eyelet formed through the badge base for receiving a strap of a badge tag. The badge label 102 also may have a destruct discontinuity 108 such as a die-cut weakening line, within the rectangular label, such as that shown in FIG. 1, which is discussed in more detail below. In addition, the printing stock 100, or the face sheet 101A, may include at least one printer-feed relief line 110 in the form of a die-cut weakening line formed therein, for example, at leading and trailing edges of the stock 100. The relief lines 110 improve the feeding of the stock 100 through printers. The overall dimensions of the sheet of stock 100 may be, for example, about 4 inches by about 6 inches (or the comparable standard metric sheet dimensions); other dimensions that enable passage through a SOHO printer may also be used.

Figure 2:
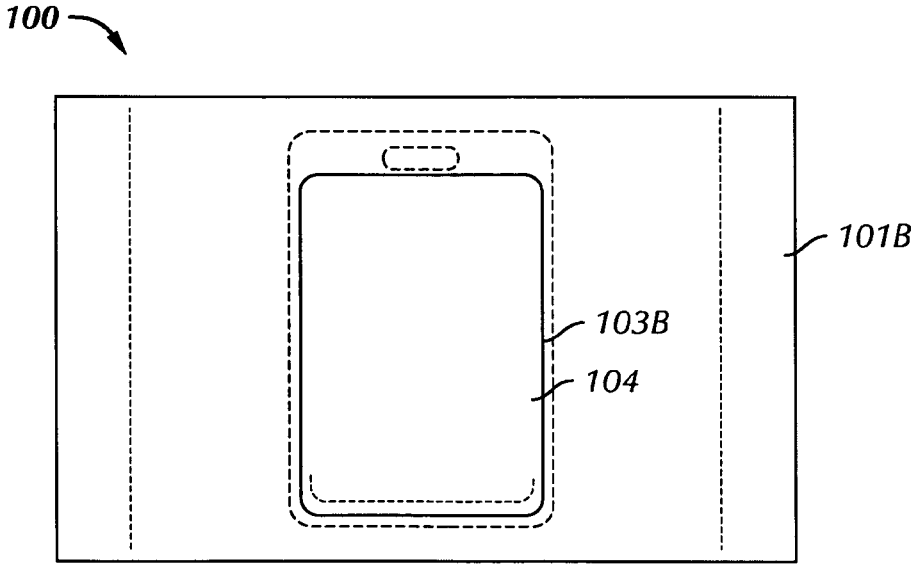
FIG. 2 is a rear plan view of the sheet of printing stock of FIG. 1.

Referencing FIG. 2, the liner side of the stock 100 may have weakening lines 103B defining the badge liner 104 that, in a number of embodiments, may be parallel to or substantially concentric with the weakening lines 103A of the face sheet 101A. In some of the embodiments, liner weakening lines 103B may be offset by a small amount on three sides and by a larger amount on one side from the face weakening lines 103A. For example, the larger offset distance between the weakening lines 103A and 103B may be on the side of the badge label 102 with the eyelet 106.

Figure 3:
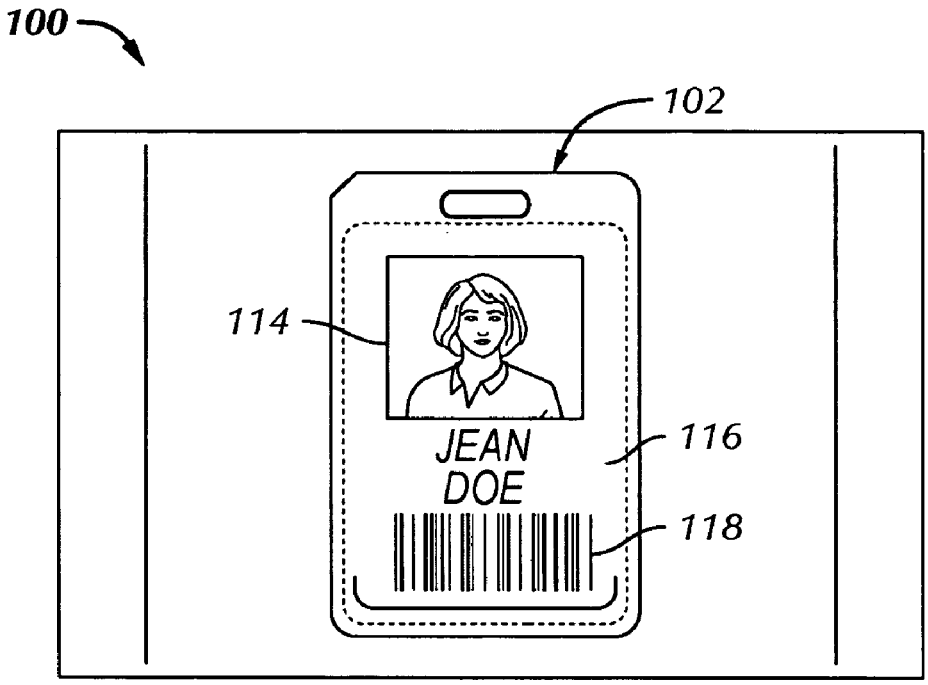
FIG. 3 is a front view of the sheet of printing stock with identifying features printed on the label.
Figure 4:
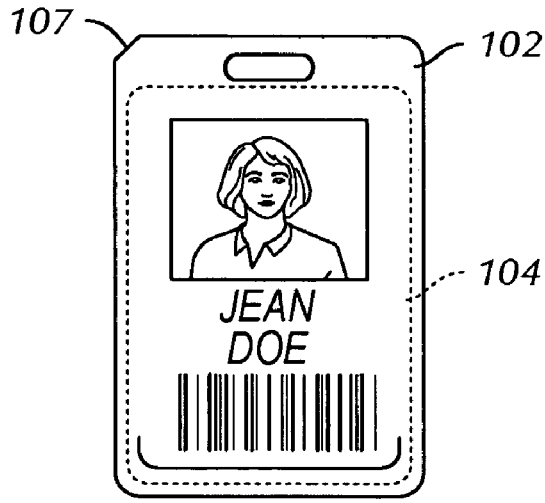
FIG. 4 is a front plan view of the label removed from the sheet of printing stock.

An image that is useful for identification, such as a photograph 114, text 116, and/or a bar code 118 may be printed on the badge label 102 as shown in FIG. 3. Although not necessary, the printing stock 100 may be easily printed upon in a SOHO printer, such as an inkjet, a laser, or a color laser printer. Once printed, the badge label 102 may be removed from the printing stock 100 and may appear as shown in FIG. 4.

Figure 5:
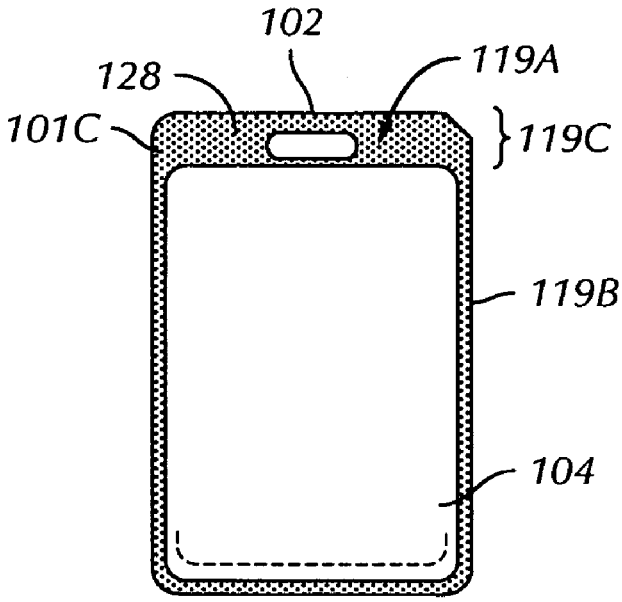
FIG. 5 is a rear plan view of the label removed from the sheet of printing stock according some of the embodiments.

As shown in FIG. 5, a portion 119A of the adhesive 101C on the back or underside of the badge label 102 may then be exposed. In a number of embodiments in which the badge liner 104 is smaller in all dimensions than that of the badge label 102, the exposed portion 119A of the adhesive 101C may extend around a periphery of the badge liner 104 as shown. This peripheral exposed adhesive 119A may be described as an adhesive margin 119B that extends around the badge liner 104. In other embodiments, the exposed portion 119A of adhesive 101C may be present on only a single side or area; that is, the badge liner 102 may have at least one dimension that is substantially the same as that of the badge label 102. In still other embodiments, the margin 119B may be larger along one side of the badge liner 104, as indicated by reference number 119C. This larger portion 119C may be used as the portion of exposed adhesive to initially position the badge label on a badge base, as described in more detail below.

Figure 6:
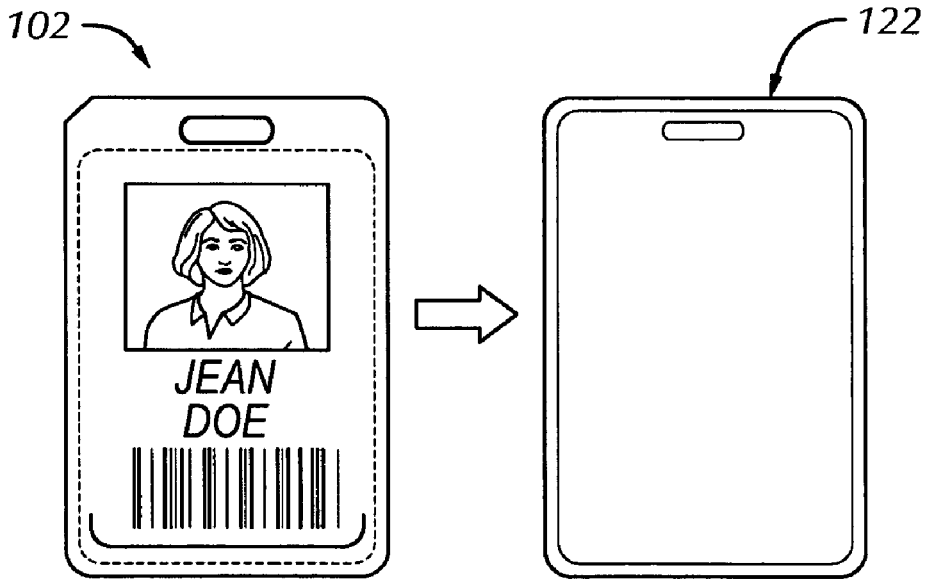
FIG. 6 is a plan view of a label and a badge base.
Figure 7:
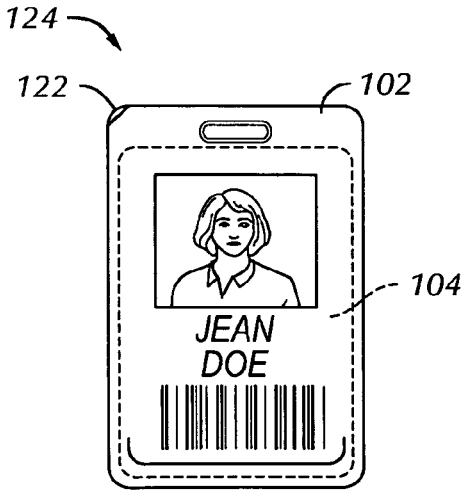
FIG. 7 shows the label mounted to the base to form a badge.

When removed from the printing stock, the badge label 102 may then be mounted on a badge card or base 122 as shown in FIG. 6. The badge base 122 may be any type of base, including a magnetic strip badge base or an RFID badge base as shown in FIG. 6. Once the badge label 102 is mounted on the base 122, an information badge 124 may have an appearance similar to that shown in FIG. 7.

Figure 8:
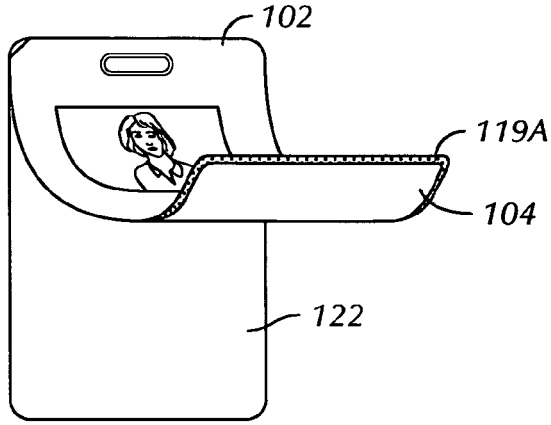
FIG. 8 illustrates a mounting step in which a lower portion of the label is peeled away from the base.

As shown in FIG. 8, alignment of the badge label 102 with the badge base 122 may be facilitated by the presence of a badge liner 104 (see also FIG. 5) over most of the back of the badge label 102. The user may align the outer edges of the badge label 102 with the outer edges of the badge base 122 and may then press an area 128 with a relatively large amount of exposed adhesive 119A (see FIG. 5) to anchor the badge label 102 to the badge base 122. Next, the user may lift the badge label 102 from the opposite end as shown in FIG. 8, which, due to a relatively small amount of exposed adhesive 119A, has either a weak bond or no bond with the base 122 underneath. The user may then remove the badge liner 104 and press down on the liner-less badge label 102 to adhere the entire badge label 102 to the base 122, to complete the badge 124.

In the event that the badge label 102 is not properly aligned with the base 122 before the liner 102 is removed, then the partially adhered badge label 102 may be removed from the base 122 by peeling, repositioned or realigned with the badge base 122, re-adhered to the base 122 when properly aligned. The badge liner 104 may then be removed to complete the badge 124.

Figure 5A:
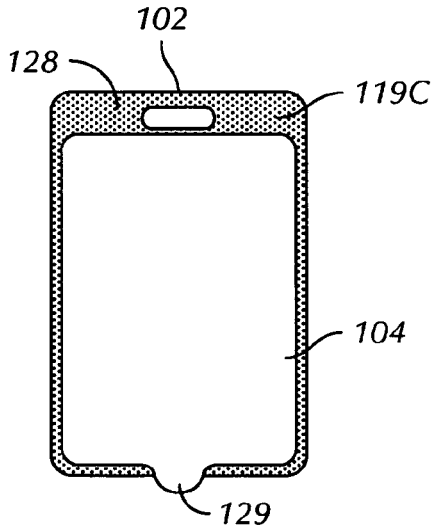
FIG. 5A is a rear plan view of the label removed from the sheet of printing stock according to other embodiments.

Alternately, the badge liner 104 may include a tab 129 that protrudes beyond the face stock of the badge label 102 as shown in FIG. 5A. The tab 129 may be grasped to facilitate the removal of the badge liner 104 from the badge label 102.

Figure 9:
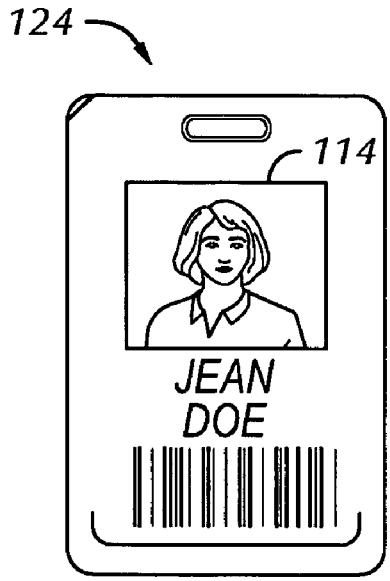
FIG. 9 is a plan view of a badge.

An example of a completed information badge 124 is shown in FIG. 9. This embodiment of the badge 124 may be utilized for visitor identification. The badge 124 may include an RFID circuit or magnetic strip for providing desired access, while the photograph 114 may identify the visitor.

Figure 9A:
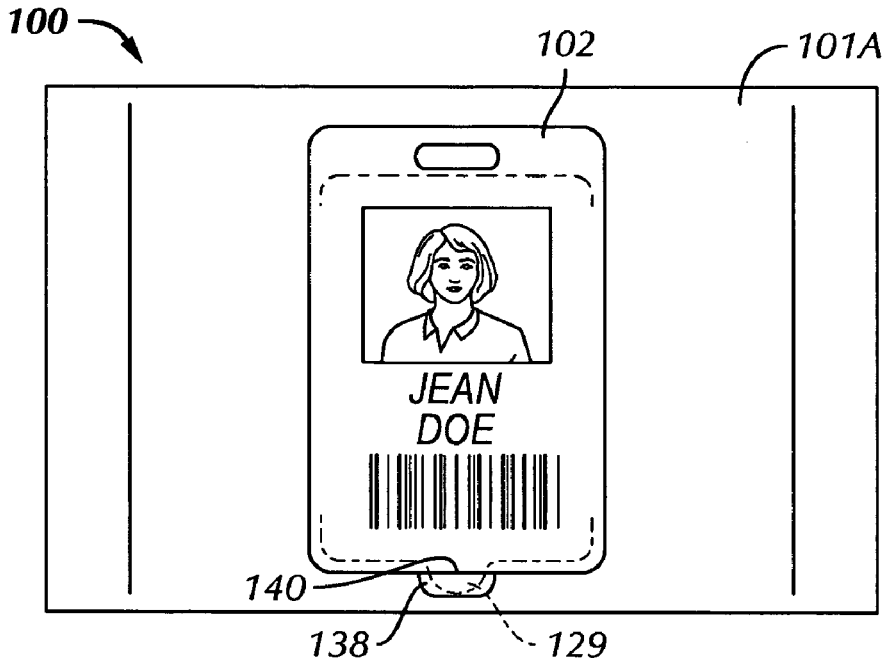
FIGS. 9A through 9F illustrate methodology for making an information badge according to a number of embodiments.
Figure 9B:
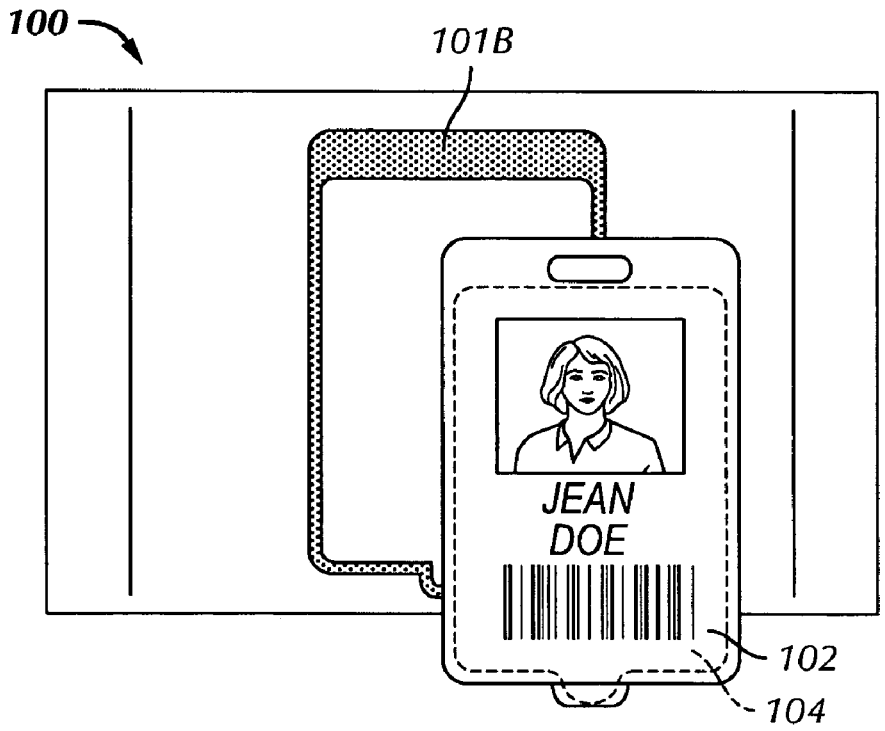

One embodiment to improve the ease of removal of the badge liner 104 is to include the tab 129 that extends beyond the perimeter of the badge label 102 as described above with reference to FIG. 5A. The front of the badge label 102 may include a small tab section 138 that coincides or is superimposed with the tab 129 of the badge liner 104, extending slightly beyond it, as shown in FIG. 9A. The badge label 102 may have a weakening line 140 between the tab section 138 and the badge portion of the badge label 102, wherein weakening line 140 may be a die cut, a perforation, or a die cut with one or more ties at fixed intervals. When removed from the carrier sheet 100, the badge label 102 appears as shown in FIG. 9B.

Figure 9C:
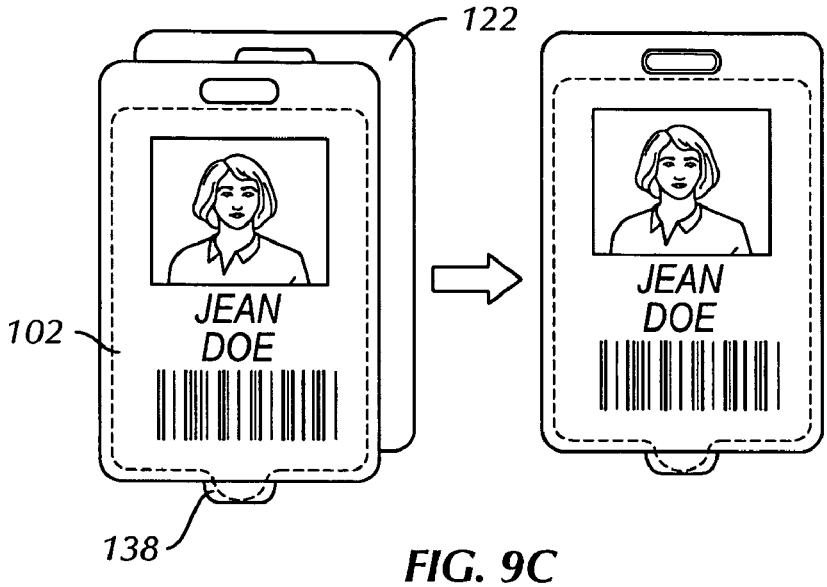

The badge label 102 with badge liner 104 attached may be placed directly on top of the badge base 122, and may be moved easily across the top surface of the base 122 because the badge liner 104 over most of the badge label 102 may keep most of the exposed adhesive 119A from adhering. Once correct alignment has been achieved, the user may press the area opposite the tab 129 in order to attach that portion of the badge label 102 to the base 122. The badge label 102 and the base 122 may appear as shown in FIG. 9C before and after alignment of the badge label 102 to the base 122.

Figure 9E:
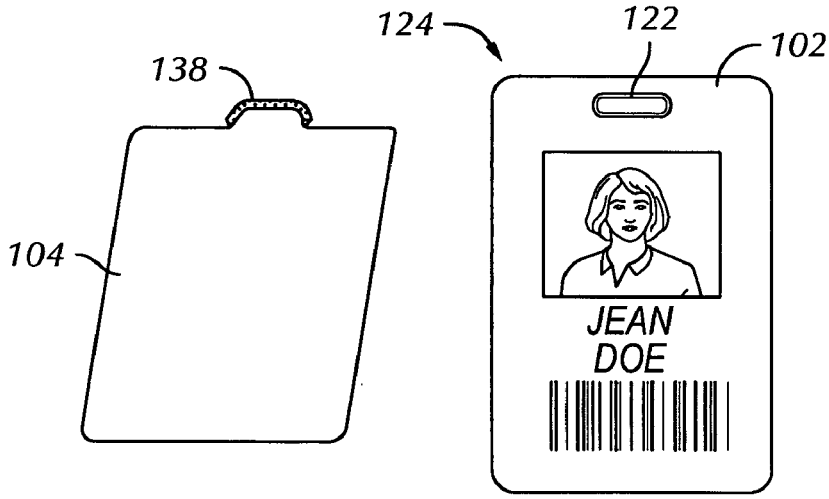
Figure 9G:
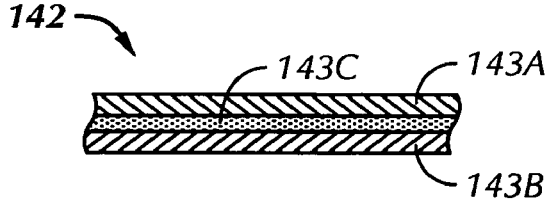
FIG. 9G is a cross-sectional view of a laminating assembly according to some of the embodiments.
Figure 9D:
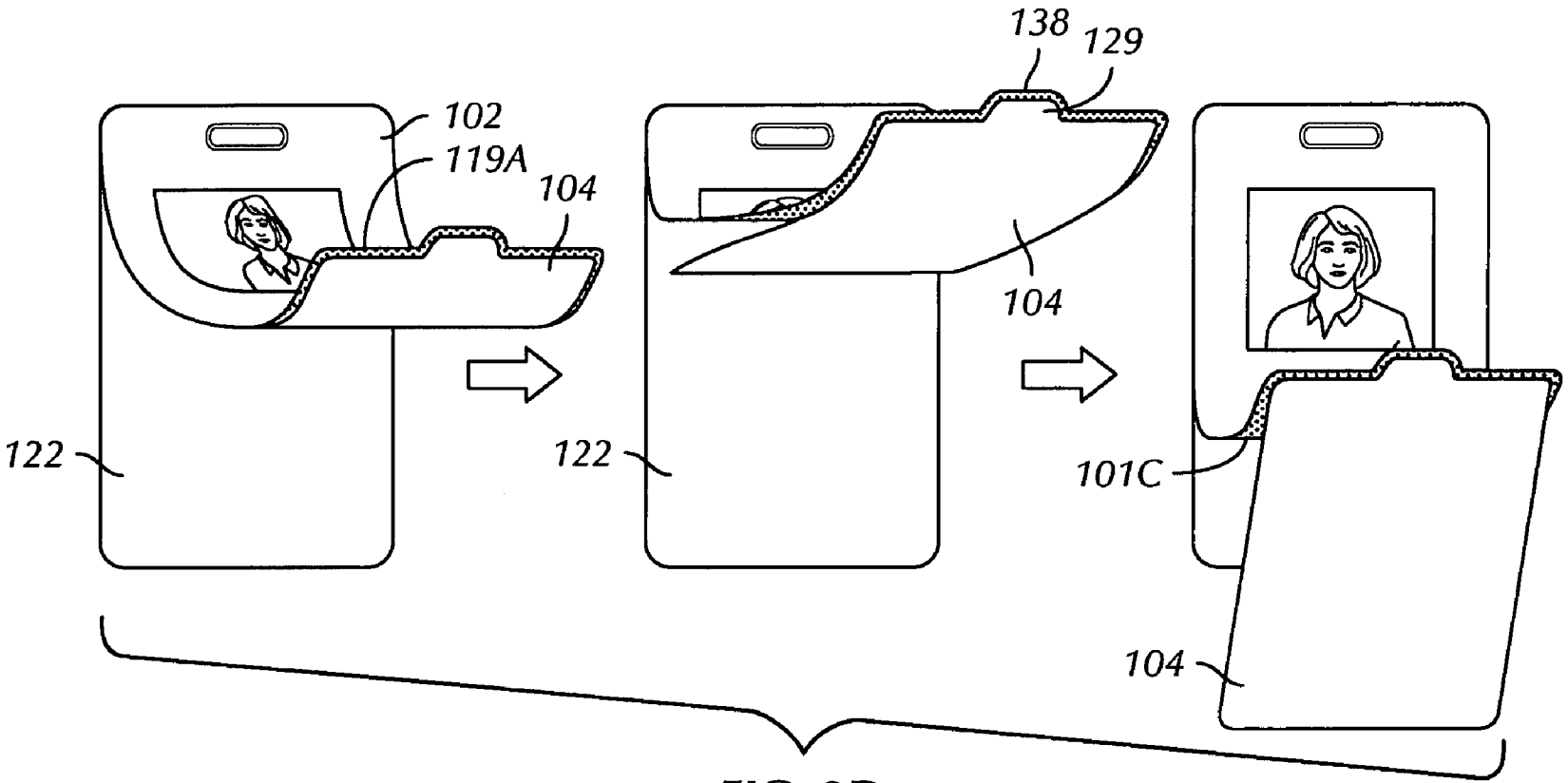

The user may ideally utilize the tab 129 to lift the unadhered portion of the badge label 102, separate the badge liner 104 at the end nearest to the adhered portion of the badge label 102, and roll the badge label 102 onto the base 122, as shown in FIG. 9D. The badge liner 104 may remain attached to the tab portion 138 of the face and the tab portion 138 of the face may separate from the label. The discarded badge liner 104 with the attached face tab 138 and the base 122 with the badge label 102 may appear as shown in FIG. 9E. The user may press the entire badge label 102 onto the base 122 to increase the strength of the adhesive bond, thereby completing the badge 124.

Figure 9F:
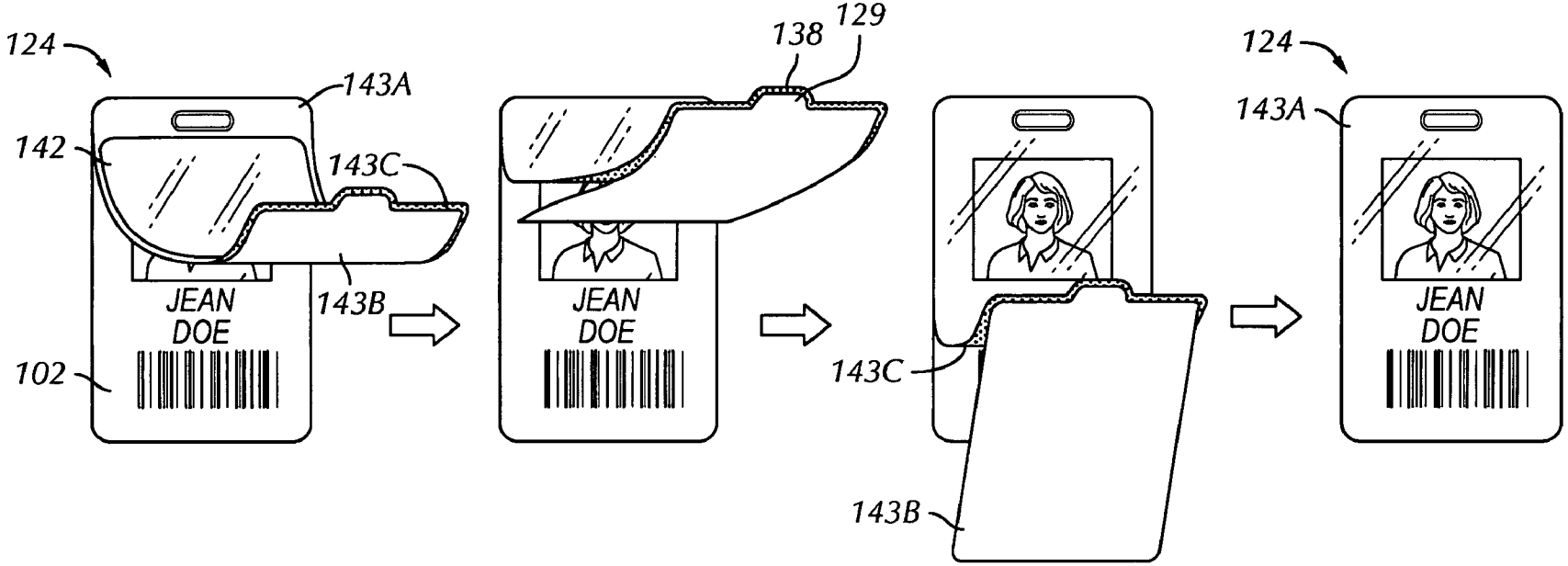

With reference to FIGS. 9F and 9G, if desired the user may also apply a laminating assembly 142 including a clear film laminating label 143A, a liner 143B, and adhesive 143C to a completed badge 124. The application of the laminating label 142 may be accomplished using analogous design and structure as that of the badge label 102 with badge liner 104 to the base 122. The application of the laminating label 142 may provide additional protection for longer term usage. One of the advantages of the liner 143B in this embodiment is that the laminating label 143A can be applied to badge label 102 on the access control badge 122 without a user touching or having contact exposed adhesive 143C of the laminating assembly 142. Accordingly, the fingerprints on the exposed adhesive 143C may be essentially eliminated during lamination.

Figure 10:
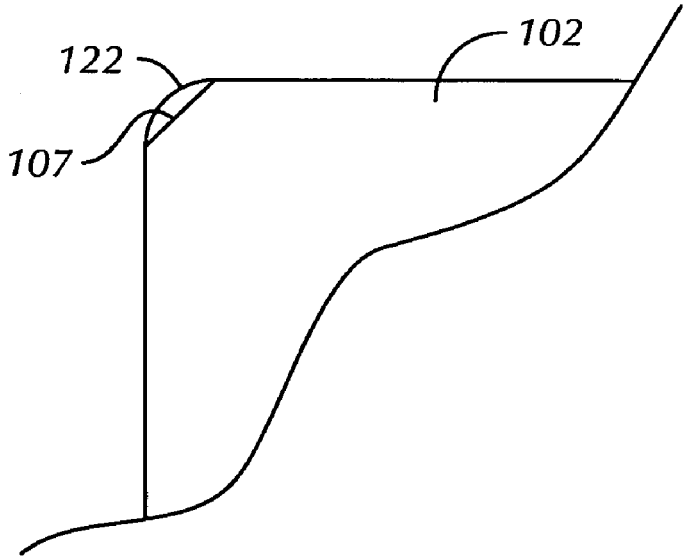
FIG. 10 is an enlarged fragmentary view of a chamfered corner of the label mounted to a base.
Figure 10A:
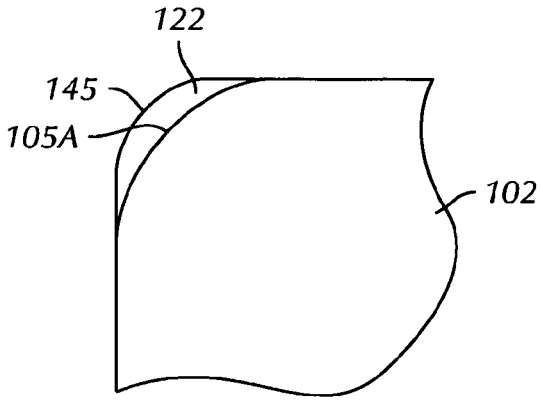
FIG. 10A is an enlarged fragmentary view of a large corner radius of a badge label according to some of the embodiments.
Figure 10B:
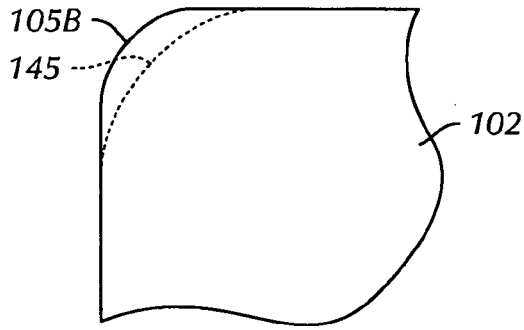
FIG. 10B is an enlarged fragmentary view of a small corner radius of a badge label according to other embodiments.
Figure 11:
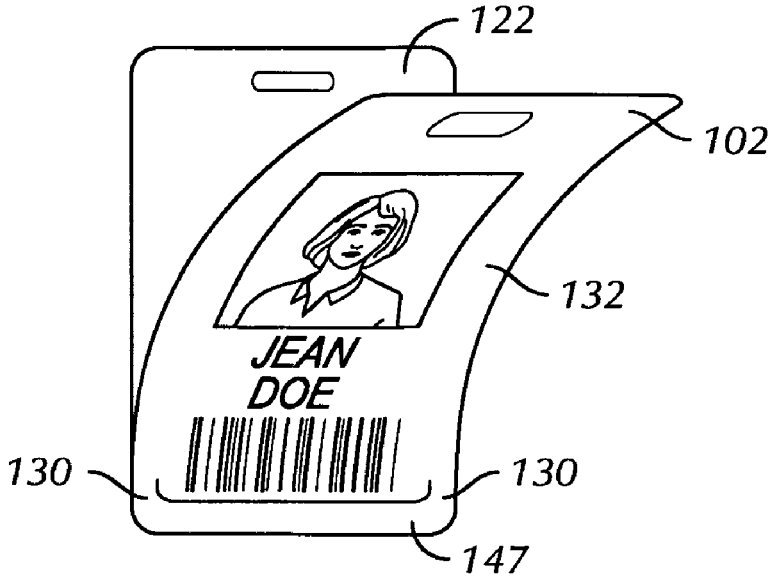
FIG. 11 illustrates a label being removed from a badge base.

The chamfer 107 may be provided on one of the corners of the badge label 102 so that a portion of the badge base 122 is exposed, as shown enlarged in FIG. 10. The purpose of this feature is to provide an edge that can easily be caught utilizing a fingernail or some other blade type device. This is to provide a starting point for removal of the badge label 102 when the visitor has completed their visit and returned the badge 124 to the hosting business. In other embodiments in which a chamfer is not provided, one of the corners of the badge label 102 may have a radius 105A that is larger than a radius 145 of the base 122 as shown in FIG. 10A so that a corner of the base 122 is exposed, or may have a radius 105B that is smaller than the radius 145 of the base 122 as shown in FIG. 10B so that the smaller-radius corner of the badge label 102 projects over the radius 145 of the base 122 to provide a grasping tab for facilitated removal. Once the badge 124 has been returned, the hosting business may remove the badge label 102 by catching the corner edge at the chamfer 107 shown in FIG. 10 and peeling the badge label 102 away from the badge base 122 as shown in FIG. 11.

Figure 12:
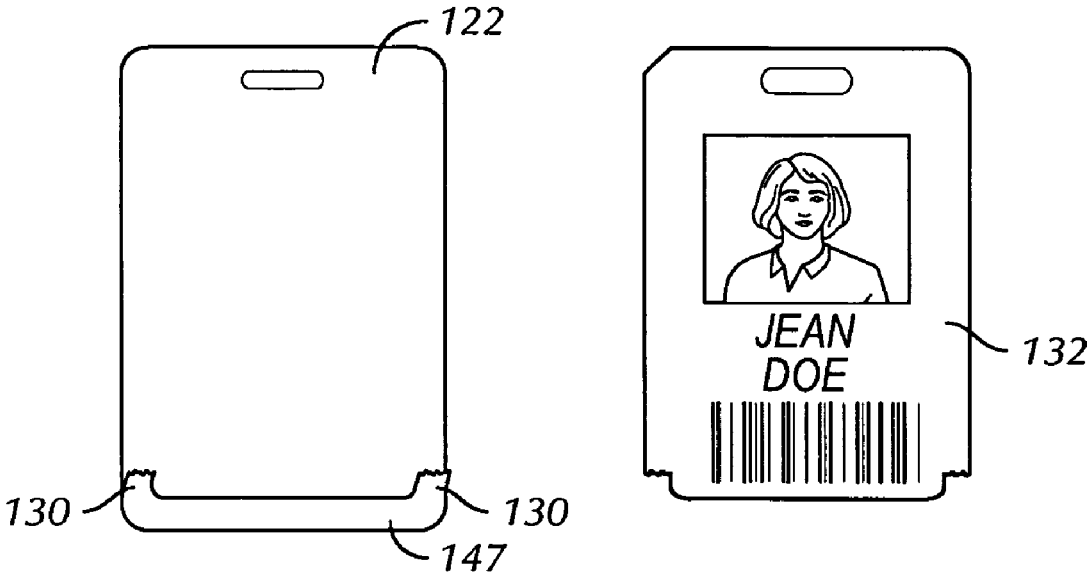
FIG. 12 illustrates a self-destructive feature of the label in which the label is torn in two pieces upon removal from a base.
Figure 13:
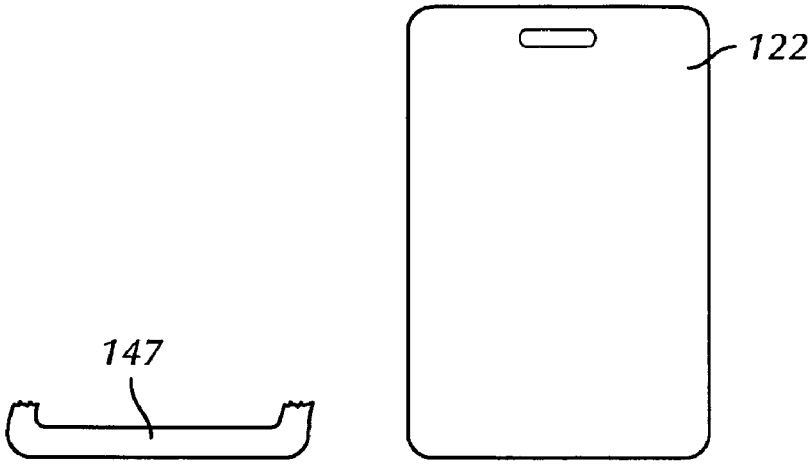
FIG. 13 illustrates the remaining portion of the label being removed from the base.

As mentioned above with reference to FIG. 1, in some of the embodiments the badge label 102 may include a destruct discontinuity 108, such as a weakening line or die cut. In a number of embodiments, the destruct discontinuity 108 may be positioned near or along one of the sides or edges of the badge label 102, e.g., at the bottom of the badge label 102 as shown in the figure. With reference to FIG. 11, when the badge label 102 is removed from the base 122, the adhesive bond of a lower section 147 of the badge label 102 will exceed the tear strength of narrow sections 130 that attach an upper section 132 of the badge label 102 to the lower section 147 of the badge label 102, causing the upper section 132 to separate from the lower section 147. In other words, the removal of the badge label 102 may cause the badge label 102 to tear at the destruct discontinuity 108. The lower section 147 may remain on the base 122, as shown in FIG. 12, with the upper section 132 being destroyed and not suitable for reuse. Typically, before tearing, the corners of the lower section 147 may have lifted from the base 122, making final removal of the lower section 147 from the badge 122 less time consuming. The final step may be the removal of the lower section 147 of the badge label 102 from the base 122, readying the base 122 for future re-use, as shown in FIG. 13.

Figure 15:
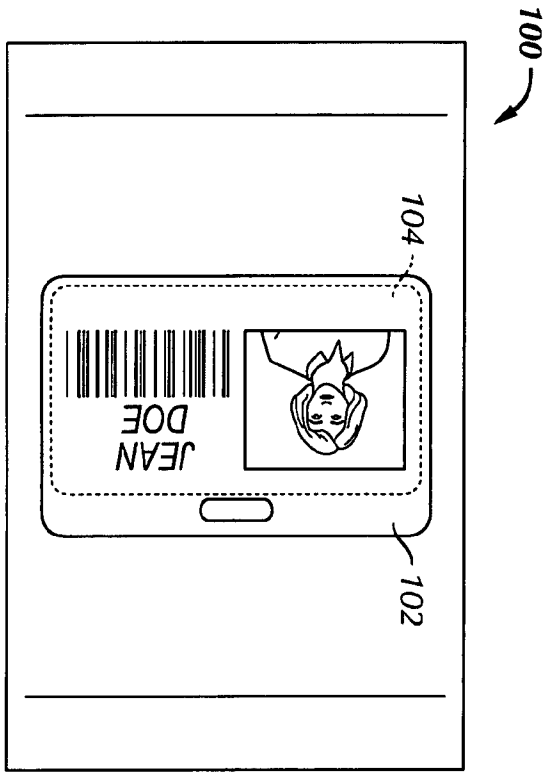
FIG. 15 illustrates a landscape orientation of the label.
Figure 14:
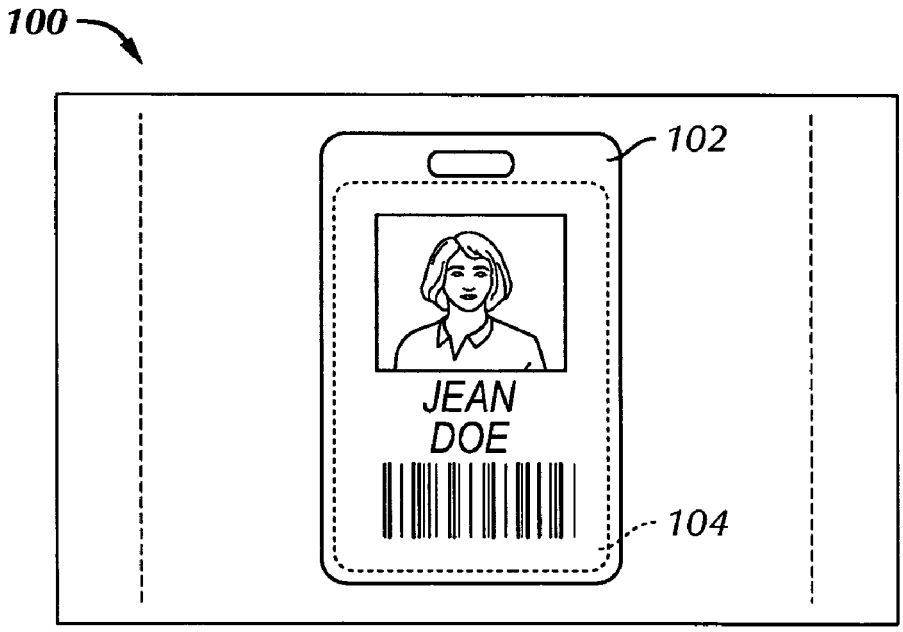
FIG. 14 is a plan view of a sheet of printing stock that includes material to render a substantially permanent badge.

Another embodiment of the printing stock 100 is illustrated in FIG. 14 and may be utilized for employee identification. In these embodiments, the stock 100 may not include the features that facilitate removal and/or tamper evidence, such as the chamfer 107, different size radii 105A and 105B, or the destruct discontinuities 108. In some of the embodiments, the material of the printing stock 100 may have a measure of durability, utilizing film as a base material with inkjet, laser, or color laser receptive top-coatings that resist scratching and wear. Alternately, a less durable material may be used if the badge were to be otherwise protected, either by providing a supplemental carrier such as a badge holder or by using a secondary clear over-laminating label. The same features may be incorporated whether the badge is in the portrait orientation as shown above, or in a landscape orientation as shown in FIG. 15.

Figure 16:
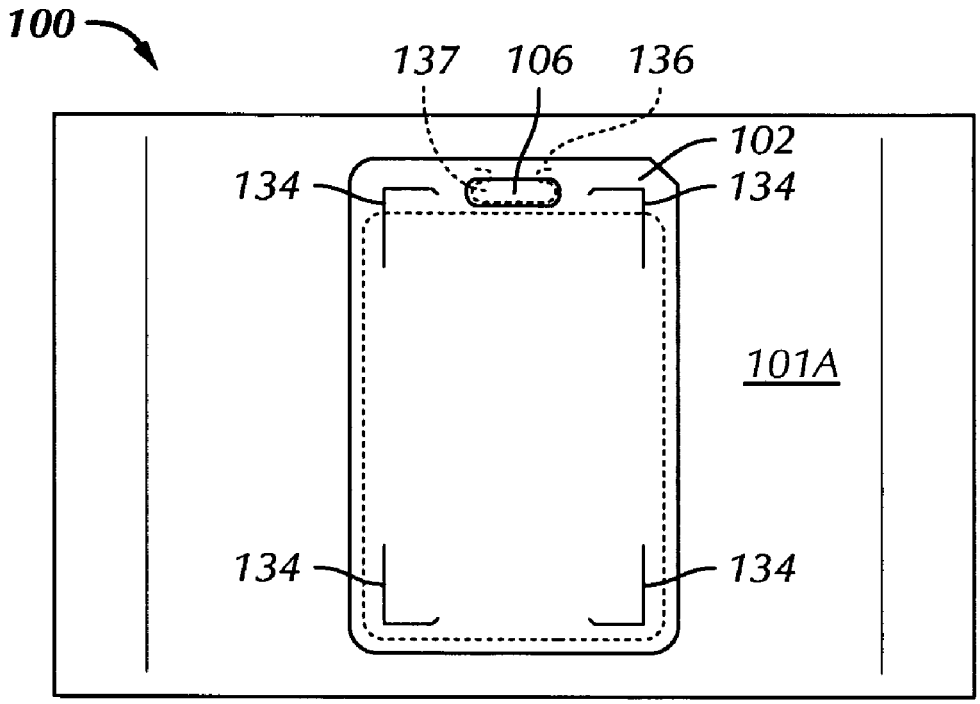
FIG. 16 illustrates another embodiment of the sheet of printing stock.
Figure 17:
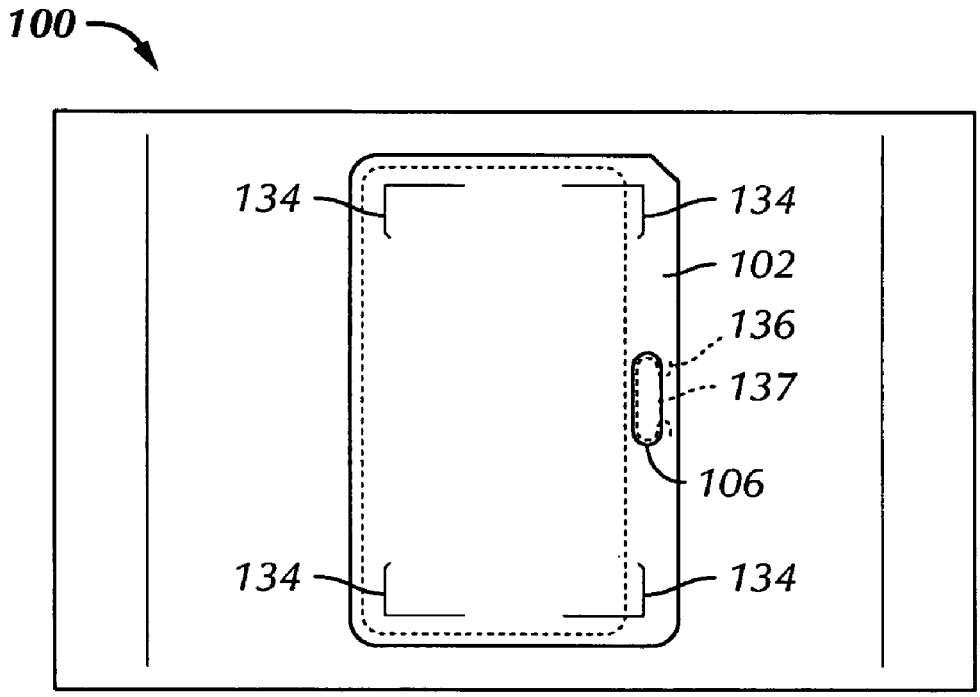
FIG. 17 illustrates a landscape orientation of the label of FIG. 16.

In other embodiments, such as shown in FIGS. 16 and 17, the badge label 102 may include a plurality of destruct discontinuities 134 in the form of weakening lines positioned at or near the corners of the badge label 102. Analogous to the destruct discontinuity 108 described above, the destruct discontinuities 134 enhance the self-destructing nature of the badge label 102 when being removed from a base 122, thereby providing tamper resistance and reusability. In some of the embodiments, the destruct discontinuities 134 may be L-shaped cuts which may be less likely to separate during application of the badge label 102 to a base 122.

The badge liner 104 may also include an eyelet cut 136 defining a tab-like section 137 disposed spatially over the eyelet 106 in the face sheet. Accordingly, when the badge label 102 is removed from the printing stock 100, the tab-like section 137 retains the portion of the face sheet 101A within the eyelet 106, so that the portion of the face sheet 101A of the eyelet 106 is retained by the liner 101B.

In other embodiments, the badge label 102 may not include the chamfer 107. In still other embodiments, the badge label 102 may not include the eyelet 106. In these latter embodiments, the eyelet may be formed after the badge label 102 has been applied to a base 122. In addition, the printing stock 100 may include a water-resistant film layer to increase the durability of the badge 124.

Figure 18:
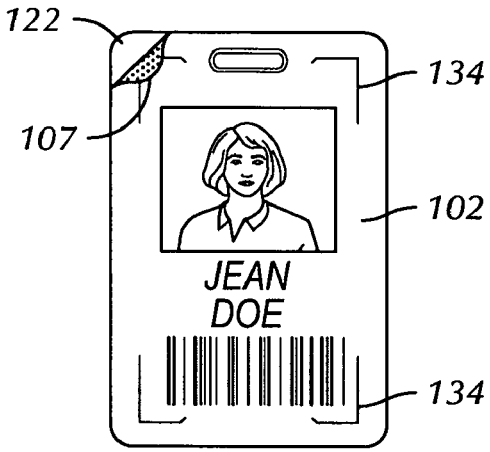
FIG. 18 is a plan view of printing stock with a badge label with a destruct discontinuity according to some of the embodiments.
Figure 20:
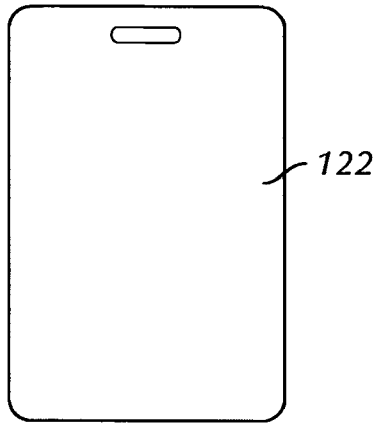
FIG. 20 is a plan view of a badge base that can be reused a plurality of times with printed badge labels.
Figure 19:
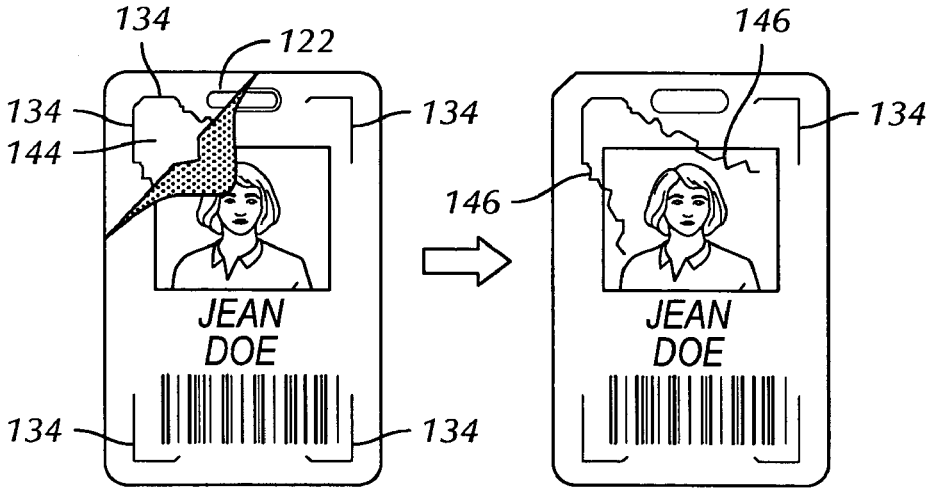
FIG. 19 illustrates the badge label of FIG. 18 tearing at the destruct discontinuity.

Once the badge 124 has been returned, the hosting business may remove the badge label 102 by catching the chamfer 107 shown in FIG. 10 and peeling the badge label 102 away from the base as shown in FIG. 18. If the badge label 102 includes destruct discontinuities 134 such as the die cuts at the corners of the badge label 102, when the badge label 102 is being removed, the adhesive bond in the area inside of the destruct discontinuities 134 will exceed the tear strength of the face sheet 101A, causing the face sheet 101A to tear as shown in FIG. 19. The destruct discontinuities 134 may also form letters, shapes, or separate the entire badge label 102 into two or more sections. In some of the embodiments, the destruct discontinuities 134 may be designed such that the user may catch or uplift the section 144 of the badge label 102 that is remaining on the base 122, and then remove the entire badge label 102 from the base 122 as shown in the right-hand drawing of FIG. 19. It may come off in one piece for easy removal, but it may be torn and may not be re-used because the appearance may be significantly altered as shown by the tear lines 146. After removing the badge label 102, the base 122 is ready for future re-use, as shown in FIG. 20. One of the advantages of the embodiments shown in FIGS. 18-20 in which four L-shaped destruct discontinuities 134 are disposed near the four corners of the badge label 102, is that regardless of which corner a person attempts to remove the badge label 102 from the base 122, the badge label 102 will be damaged and rendered un-reusable.

Alternate methods of tamper evidence may also be employed. One such method may require utilizing a clear or translucent face material pattern coated on the back side of the face material with a release agent, then bonded to a pigmented adhesive, so that separation of the badge label 102 from the base 122 extracts visible patterns of adhesive from the clear or translucent face material, rendering both parts visibly altered. Another method of tamper evidence is to have the face material inherently weak or somehow weakened so that the adhesive bond destroys the badge label 102 when attempting to remove it from the base 122. Another method leaves darkened sections of material on the base 122. Another method is to use an extensible label material such as vinyl that may deform upon removal. This label may incorporate any of the above mentioned tamper evident features, as well as others, or it may incorporate no tamper evident feature.

Figure 21:
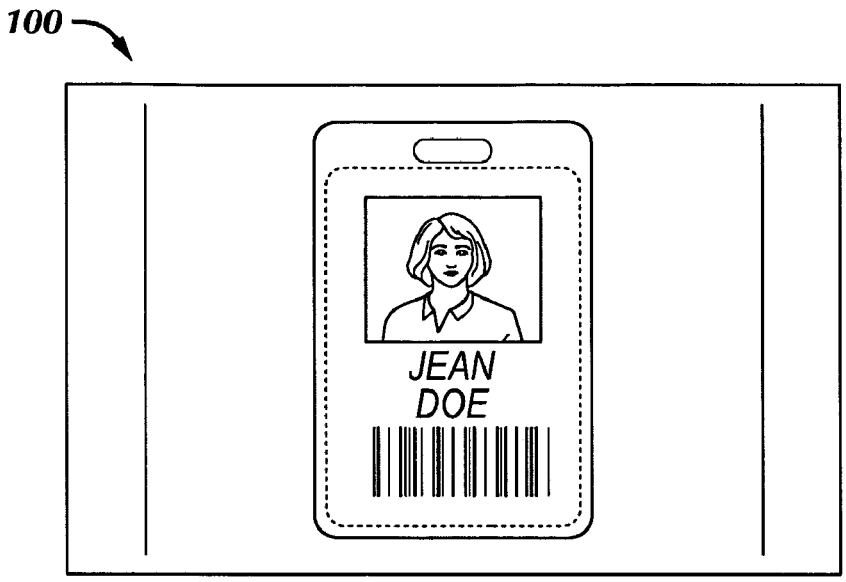
FIG. 21 illustrates a portrait orientation of a badge label in a piece of printing stock.

Another embodiment of the present invention may be utilized for longer term usage, such as employee identification, and is a variation of the above embodiments that may or may not eliminate the features that facilitate removal and/or tamper evidence, as shown in FIG. 21. It is preferable that the material and the printable topcoating chosen has a measure of durability, utilizing, for example, a film as a base material with an inkjet, laser, or color laser receptive topcoating that resists scratching, water damage and wear. Alternately, liquid sealant may be sprayed or brushed on the coating to provide another layer of protection. Alternately, a less durable material may be used if the badge were to be otherwise protected, either by providing a supplemental carrier such as a badge holder or a self-adhesive clear sleeve, or by using a secondary clear over laminating label. Alternately, the label sheet may be formed of a clear film and a printable liner. The clear face may have weakening lines forming a rectangular shape, and the printable liner side may be die cut to form a printable section that may preferably be within the boundary of the rectangular clear film label. Once printed, this printable liner section may be removed from the carrier sheet or printing stock, inverted, and placed back on the clear film with the printed side against the adhesive. The printed section may be smaller than the over laminate rectangular shape, so that the assembly may be removed from the carrier and bonded to the base, it may be held in place by the exposed adhesive on the over laminate film. Alternately, a patterned release coating on the film under the printable liner section may form a label assembly whereby the adhesive bonds to the back side of the printed base, creating a larger adhesive coated area for an improved bond. In other embodiments, the liner may also be a clear film and may be reverse printed (i.e., mirror-image printing). By removing the appropriate portion of the perimeter of the liner, adhesive is exposed along the perimeter of the label. The label can be directly applied to the badge. As the image is reverse printed, the image is now correctly oriented when applied.

Figure 22:
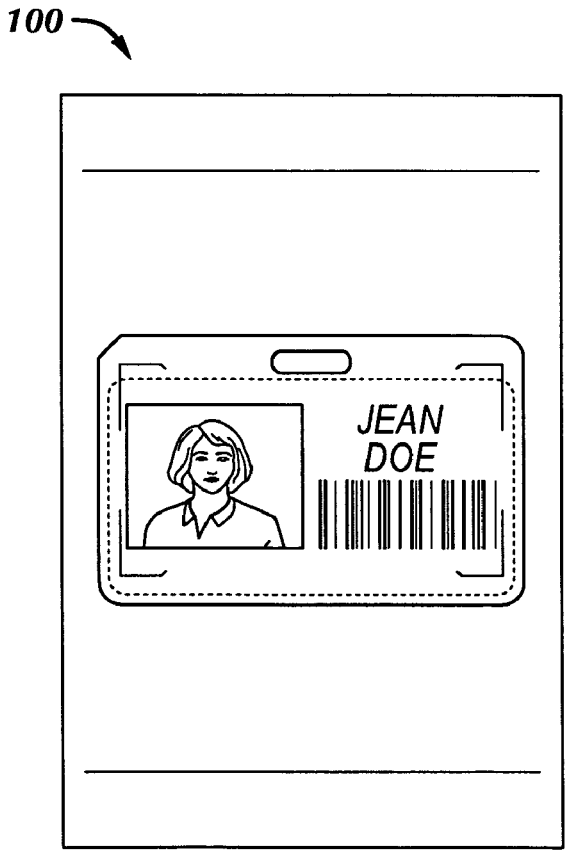
FIG. 22 illustrates a landscape orientation of a badge label in a piece of printing stock.
Figure 23:
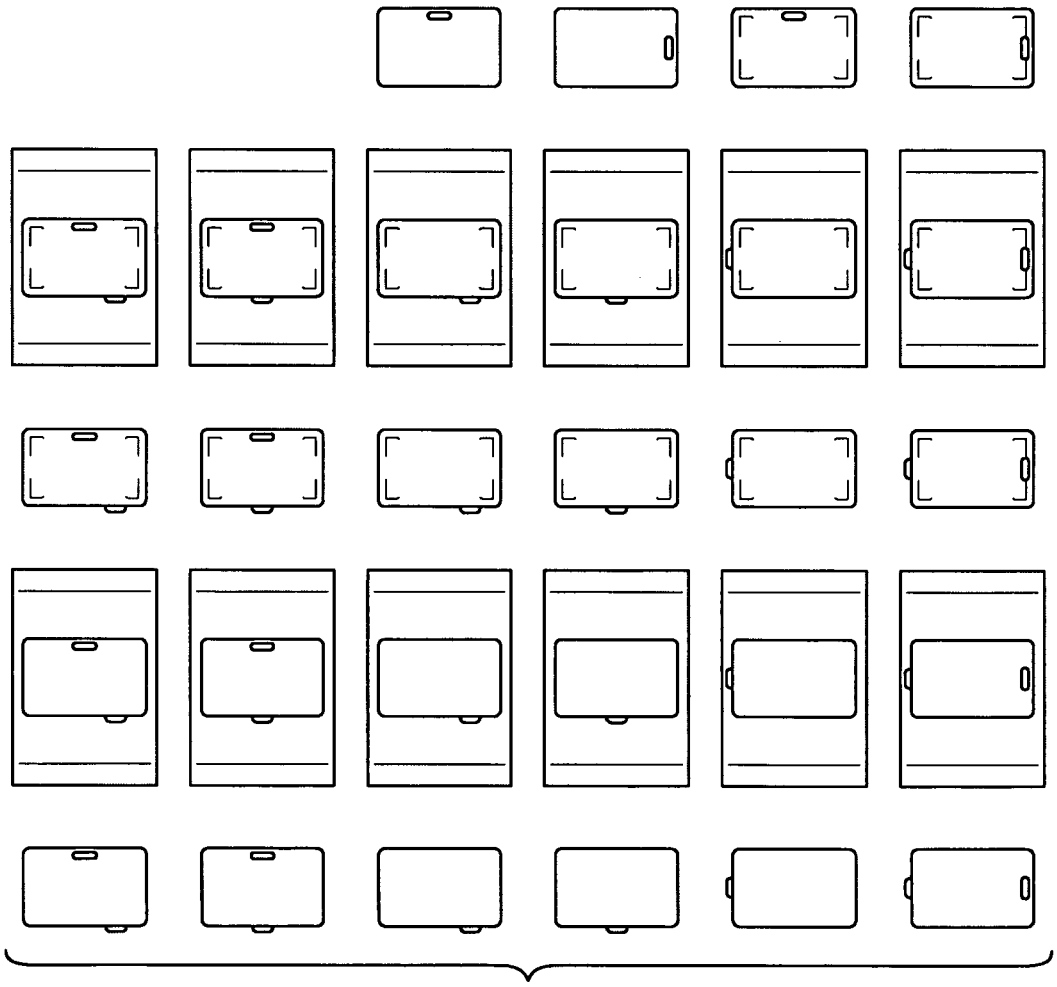
FIG. 23 illustrates a plurality of orientation embodiments of a badge label and printing stock.

The same features of the embodiments described above may be incorporated whether the badge is in the portrait orientation as shown in FIG. 21 or in the landscape orientation as shown in FIG. 22. Other features may also be incorporated, such as time indicating features. In addition, there may be more than one badge label 102 formed in a single piece of printing stock 100 so that a plurality of badge labels may be printed in a single pass in a printer. FIG. 23 illustrates a plurality of embodiments of the printing stock 100 and the badge label 102.

Figure 24:
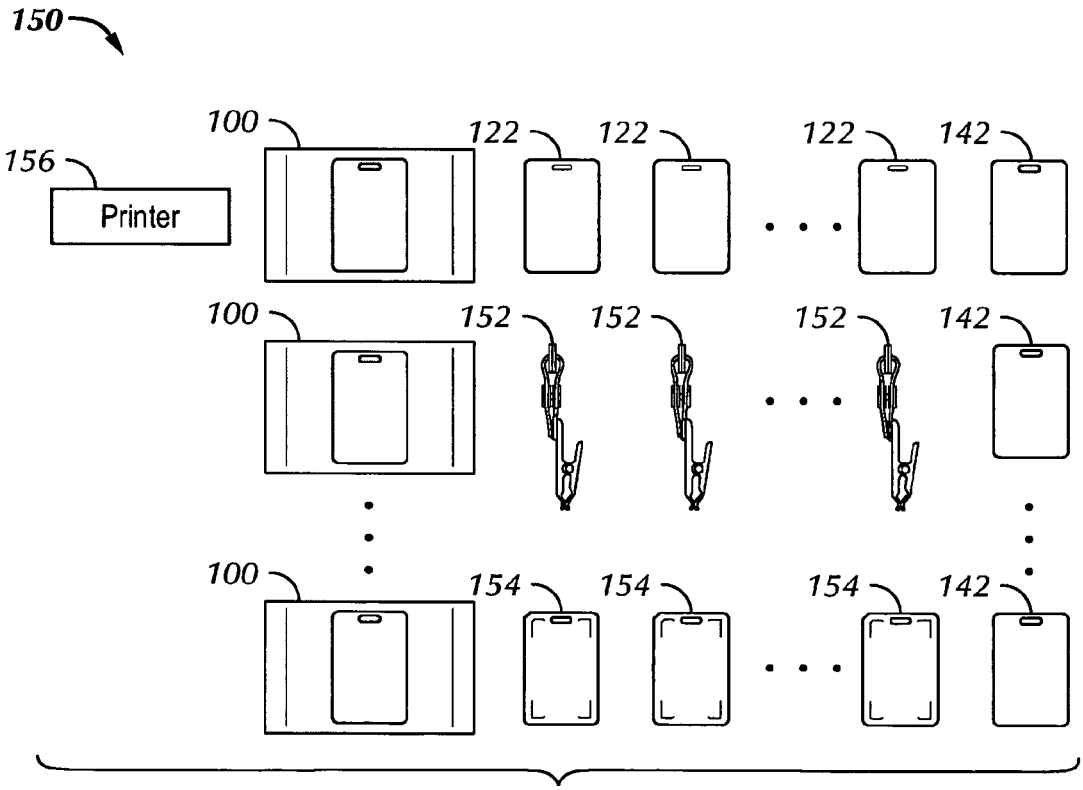
FIG. 24 illustrates a system for making information badges.

A system 150 for making information badges is shown in FIG. 24. The system 150 may include a plurality of pieces or sheets of printing stock 100 and a plurality of badge bases 122. In addition, the system 150 may include a plurality of the laminating assemblies 142 for making badges 124 with more durability. Still further, the system 150 may include a plurality of strap clips or lanyards 152 and/or a plurality of badge sleeves 154. In addition, a printer 156 may be provided through which the printing stock 100 is passable.

For the purposes of this description, the term information badge includes any type of badge that may include one or more of the following items: name, serial number, and other textual information; photograph, fingerprint, or other representative information; computer-readable devices such as bar codes, magnetic strips, RFID circuits, and so on. Examples of information badges include name badges, control-access badges, and security badges.

Those skilled in the art will understand that the preceding embodiments of the present invention provide the foundation for numerous alternatives and modifications thereto. These other modifications are also within the scope of the present invention. Accordingly, the present invention is not limited to that precisely as shown and described in the present invention.

What is claimed is:

1. Printing stock for making, in combination with a badge base, an information badge, the printing stock comprising:

a face sheet including a layer of pressure sensitive adhesive and a front portion of a badge label defined therein by a plurality of continuous die-cut lines about a complete perimeter of the front portion of the badge label and wherein the front portion of the badge label is free of perforated fold lines; and a liner releasably adhered to the layer of adhesive and including a badge liner defined therein by a plurality of continuous die-cut lines about a complete perimeter of the badge liner;

the badge liner being smaller in dimensions than the front portion of the badge label and being positioned with respect to the front portion of the badge label such that when the front portion of the badge label is removed from the face sheet, the badge liner is removed from the liner and remains adhered to the front portion of the badge label, the badge liner configured for removal from the front portion of the badge label to provide adhesion of the front portion of the badge label to the badge base;

wherein:

the front portion of the badge label includes a destruct discontinuity such that when the front portion of the badge label is adhered to the badge base and when the front portion of the badge label is peeled away from the badge base, the front portion of the badge label will tear at the destruct discontinuity.

2. The printing stock of claim 1 wherein the face sheet has dimensions for enabling passage through a small-office home-office (SOHO) printer.

3. The printing stock of claim 2 wherein the face sheet includes at least one printer-feed relief line formed therein.

4. The printing stock of claim 2 wherein the face sheet is substantially rectangular with dimensions of about 4 inches by about 6 inches.

5. The printing stock of claim 3 wherein the front portion of the badge label is substantially rectangular with dimensions of about 3⅜ inches by about 2⅛ inches.

6. The printing stock of claim 4 wherein the front portion of the badge label includes four corners, at least one of which includes a radius.

7. The printing stock of claim 1 wherein the badge liner is smaller in dimensions than the front portion of the badge label such that when the front portion of the badge label is removed from the face sheet, a portion of the adhesive is exposed about a periphery of the badge liner.

8. The printing stock of claim 7 wherein the portion of exposed adhesive defines an adhesive margin about the badge liner.

9. The printing stock of claim 8 wherein the adhesive margin is present on all sides of the badge liner.

10. The printing stock of claim 8 wherein the badge liner has four sides and the adhesive margin is larger on one of the sides of the badge liner than on the other sides of the badge liner.

11. The printing stock of claim 1 wherein the badge liner includes a tab that projects beyond a side of the front portion of the badge label.

12. The printing stock of claim 11 wherein the front portion of the badge label includes a tab section superimposed with the tab of the badge liner.

13. The printing stock of claim 1 wherein the front portion of the badge label includes a chamfer formed at a corner of the front portion of the badge label.

14. The printing stock of claim 1 wherein the front portion of the badge label has a radius at a corner thereof that is different in size than a radius of a corner of the badge base.

15. The printing stock of claim 1 wherein the front portion of the badge label includes an eyelet for receiving a strap of a badge tag.

16. The printing stock of claim 15 wherein the badge liner includes an eyelet cut positioned spatially with the eyelet of the front portion of the badge label.

17. The printing stock of claim 1 wherein the destruct discontinuity includes a weakening line cut into the face sheet.

18. The printing stock of claim 1 wherein the destruct discontinuity is positioned along a side of the front portion of the badge label.

19. The printing stock of claim 1 wherein the badge label includes a plurality of the destruct discontinuities.

20. The printing stock of claim 19 wherein the front portion of the badge label has four sides and four corners, the destruct discontinuities being positioned near the corners of the front portion of the badge label.

21. A system for printing information badges in a small-office, home-office (SOHO) printer, the system comprising:

a plurality of pieces of printing stock each including:

a face sheet including a layer of adhesive and a front portion of a badge label defined therein by a plurality of continuous die-cut lines about a complete perimeter of the front portion of the badge label and wherein the front portion of the badge label is free of perforated fold lines; and a liner releasably adhered to the layer of adhesive and including a badge liner defined therein by a plurality of continuous die-cut lines about a complete perimeter of the badge liner;

the badge liner being smaller in dimensions than the front portion of the badge label and being positioned with respect to the front portion of the badge label such that when the front portion of the badge label is removed from the face sheet, the badge liner is removed from the liner and remains adhered to the front portion of the badge label, the badge liner configured for subsequent removal from the front portion of the badge label to provide adhesion of the front portion of the badge label to a badge base, and;

a plurality of strap clips.

22. The system of claim 21 further comprising a plurality of badge bases each being configured to receive singularly the front portions of the badge labels of the of the printing stock.

23. The system of claim 22 wherein the front portions of the badge labels and the badge bases include eyelets for receiving a strap of a badge tag.

24. The system of claim 21 further comprising a plurality of laminating labels each configured to be adherent to the front portion of the badge label.

25. The system of claim 21 further comprising the SOHO printer.

26. A method for making an information badge, the method comprising:

printing information on a piece of printing stock in a small-office, home-office (SOHO) printer, the piece of printing stock including:

a face sheet including adhesive and a front portion of a badge label defined therein by a plurality of continuous die-cut lines about a complete perimeter of the front portion of the badge label and wherein the front portion of the badge label is free of perforated fold lines; and a liner releasably adhered to the adhesive of the face sheet and including a badge liner defined therein by a plurality of continuous die-cut lines about a complete perimeter of the badge liner;

the badge liner being smaller in dimensions than the front portion of the badge label and being substantially superimposed with the front portion of the badge label;

removing the front portion of the badge label from the face sheet such that the badge liner is removed from the liner with the front portion of the badge label and such that some of the adhesive is exposed;

positioning the front portion of the badge label on a badge base;

adhering the front portion of the badge label to the badge base at a portion of the exposed adhesive;

removing the badge liner from the front portion of the badge label; and adhering the remaining portions of adhesive of the front portion of the badge label to the badge base.

27. The method of claim 26 wherein in the positioning step comprises:

pressing the badge liner against the badge base; and sliding the front portion of the badge label to align the front portion of the badge label with the badge base.

28. The method of claim 26 wherein the face sheet includes pressure-sensitive adhesive, the method further comprising between the first adhering step and the removing step:

peeling the front portion of the badge label off of the badge base;

repositioning the front portion of the badge label on the badge base; and re-adhering the front portion of the badge label to the badge base at a portion of the exposed adhesive.

29. The method of claim 26 wherein the face sheet includes pressure-sensitive adhesive, the method further comprising:

removing the front portion of the badge label from the badge base; and reusing the badge base to make another one of the information badges.

30. The method of claim 29 wherein the face sheet includes a destruct continuity, wherein the step of removing the front portion of the badge label from the badge base further comprises:

removing the front portion of the badge label from the badge base such that the front portion of the badge label tears at the destruct continuity.

31. The method of claim 26 further comprising applying a laminating label on the information badge.

* * * * *